US008334641B2

(12) United States Patent
Tsai

(10) Patent No.: US 8,334,641 B2
(45) Date of Patent: Dec. 18, 2012

(54) LIGHTING DEVICE

(75) Inventor: Wen-Kuei Tsai, Taipei (TW)

(73) Assignee: Top Energy Saving System Corp., New Taipei (TW)

( * ) Notice: Subject to any disclaimer, the term of this patent is extended or adjusted under 35 U.S.C. 154(b) by 0 days.

(21) Appl. No.: 13/095,709

(22) Filed: Apr. 27, 2011

(65) Prior Publication Data

US 2012/0169201 A1 Jul. 5, 2012

(30) Foreign Application Priority Data

Jan. 4, 2011 (TW) ..... 100200061

(51) Int. Cl.
*H01J 1/02* (2006.01)

(52) U.S. Cl. ..... 313/46; 362/294; 362/249.02

(58) Field of Classification Search ..... 362/543–549, 362/555, 800, 249.01–249.03; 313/46
See application file for complete search history.

(56) References Cited

U.S. PATENT DOCUMENTS

| | | | | |
|---|---|---|---|---|
| 7,674,015 | B2 * | 3/2010 | Chien | 362/294 |
| 7,753,560 | B2 * | 7/2010 | Xu et al. | 362/294 |
| 2007/0242461 | A1 * | 10/2007 | Reisenauer et al. | 362/294 |
| 2010/0186937 | A1 * | 7/2010 | Liang | 165/185 |
| 2010/0259934 | A1 * | 10/2010 | Liu et al. | 362/294 |
| 2011/0090686 | A1 * | 4/2011 | Pickard | 362/235 |

* cited by examiner

*Primary Examiner* — Mariceli Santiago
*Assistant Examiner* — Donald Raleigh
(74) *Attorney, Agent, or Firm* — Stout, Uxa, Buyan & Mullins, LLP

(57) ABSTRACT

A lighting device includes a bottom housing, a middle housing, a top housing, and a lamp head. Specifically, the bottom housing has a bottom surface capable of supporting a lighting module. The middle housing is coupled to the top side of the bottom housing. The top housing is coupled to the top side of the middle housing, such that the middle housing is disposed between the bottom housing and the top housing. The lamp head covers the sidewall of the top housing.

11 Claims, 4 Drawing Sheets

LIGHTING DEVICE

CROSS-REFERENCE TO RELATED APPLICATIONS

The entire contents of Taiwan Patent Application No. 100200061, filed on Jan. 4, 2011, from which this application claims priority, are incorporated herein by reference.

BACKGROUND OF THE INVENTION

1. Field of the Invention

The present invention generally relates to a lighting device, and more particularly to a light-emitting diode (LED) bulb with an air channel.

2. Description of Related Art

Due to various advantages of a light-emitting diode (LED) such as small volume, short response time, low power consumption, high reliability and high feasibility of mass production, the LED is replacing conventional lighting devices such as light bulbs or fluorescent lamps.

In order to make the advantages of the LED bulb more remarkable, heat dissipation is a main issue to be addressed. Conventional LED bulbs use a variety of heat dissipation schemes such as heat dissipation blades disposed on sidewall of the bulb. However, the heat dissipation blades are inherently limited in heat dissipation efficiency.

For the foregoing reason, a need has arisen, to propose a novel lighting device with improved heat dissipation efficiency.

SUMMARY OF THE INVENTION in view of the foregoing, it is an object of the embodiment of the present invention to provide a lighting device with an air channel for effectively improving heat dissipation efficiency.

According to one embodiment, the lighting device includes a bottom housing, a middle housing, a top housing and a lamp head. The bottom housing has a bottom surface for supporting a lighting module. The middle housing is coupled to a top side of the bottom housing. The top housing is coupled to a top side of the middle housing, wherein the middle housing is disposed between the bottom housing and the top housing. The lamp head covers a sidewall of the top housing.

According to one aspect of the embodiment, an air cell is formed in the bottom housing. The air cell communicates with outside of the lighting device via an air passage and an air entrance port disposed on a sidewall of the bottom housing. Further, a punctured hole is disposed on a bottom surface of the middle housing, and an air exit port is disposed on a sidewall of the middle housing, thereby the air exit port and the punctured hole communicating with the air cell of the bottom housing. According to the aspect of the embodiment, external air enters the lighting device via the air entrance port of the bottom housing and exits from the air exit port of the middle housing, thereby carrying the LED-generated heat out of the lighting device.

DETAILED DESCRIPTION OF THE INVENTION

Figure 1A:
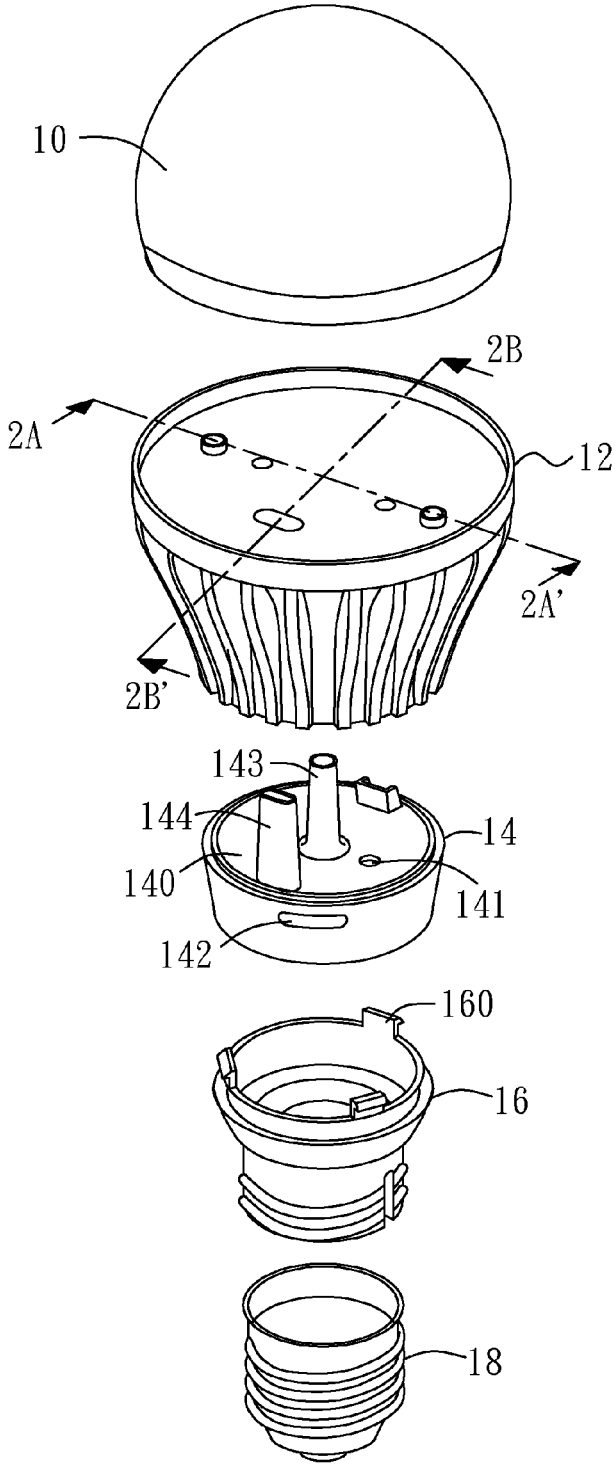
FIG. 1A shows an exploded, view of a lighting device according to one embodiment of the present invention.
Figure 1B:
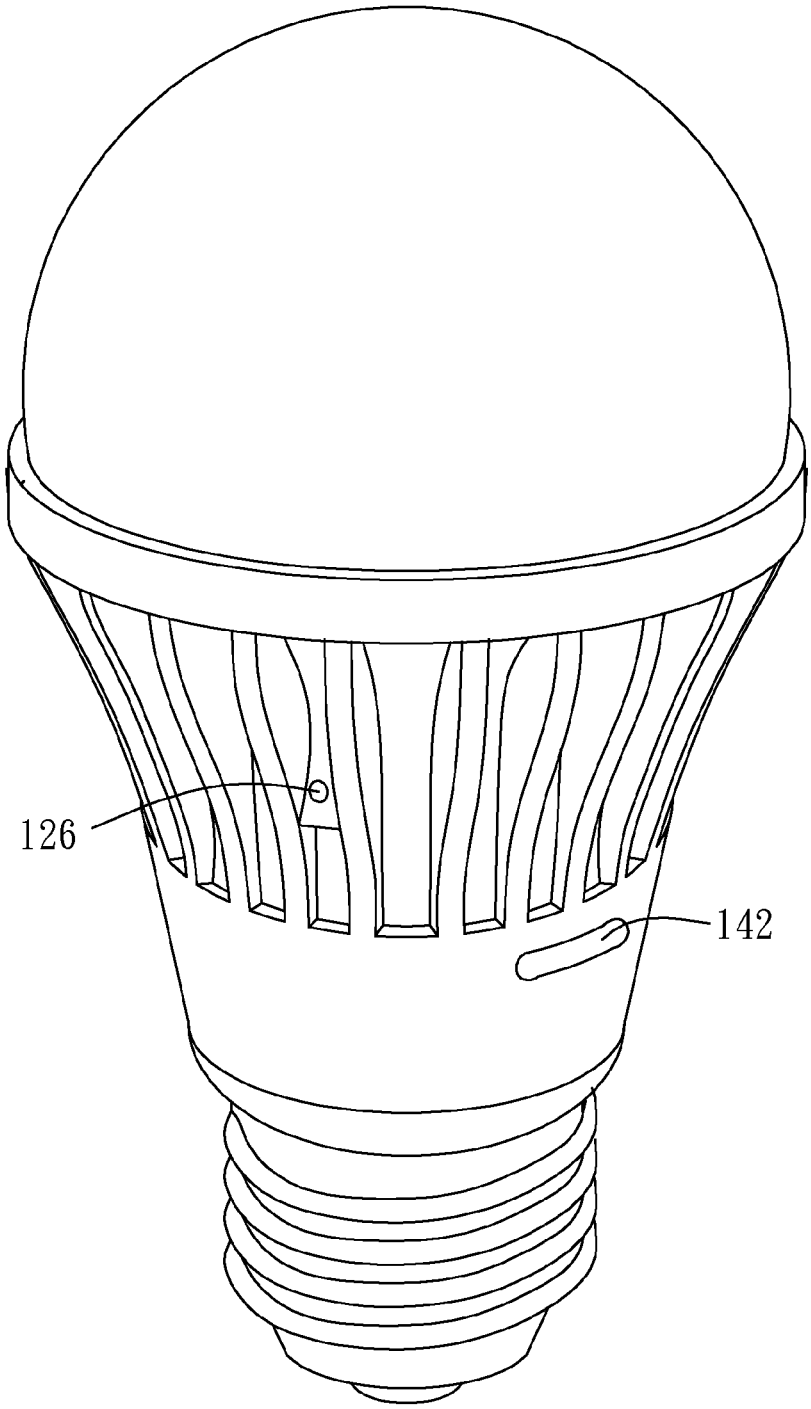
FIG. 1B shows an external view of an assembled lighting device of FIG. 1A.
Figure 1C:
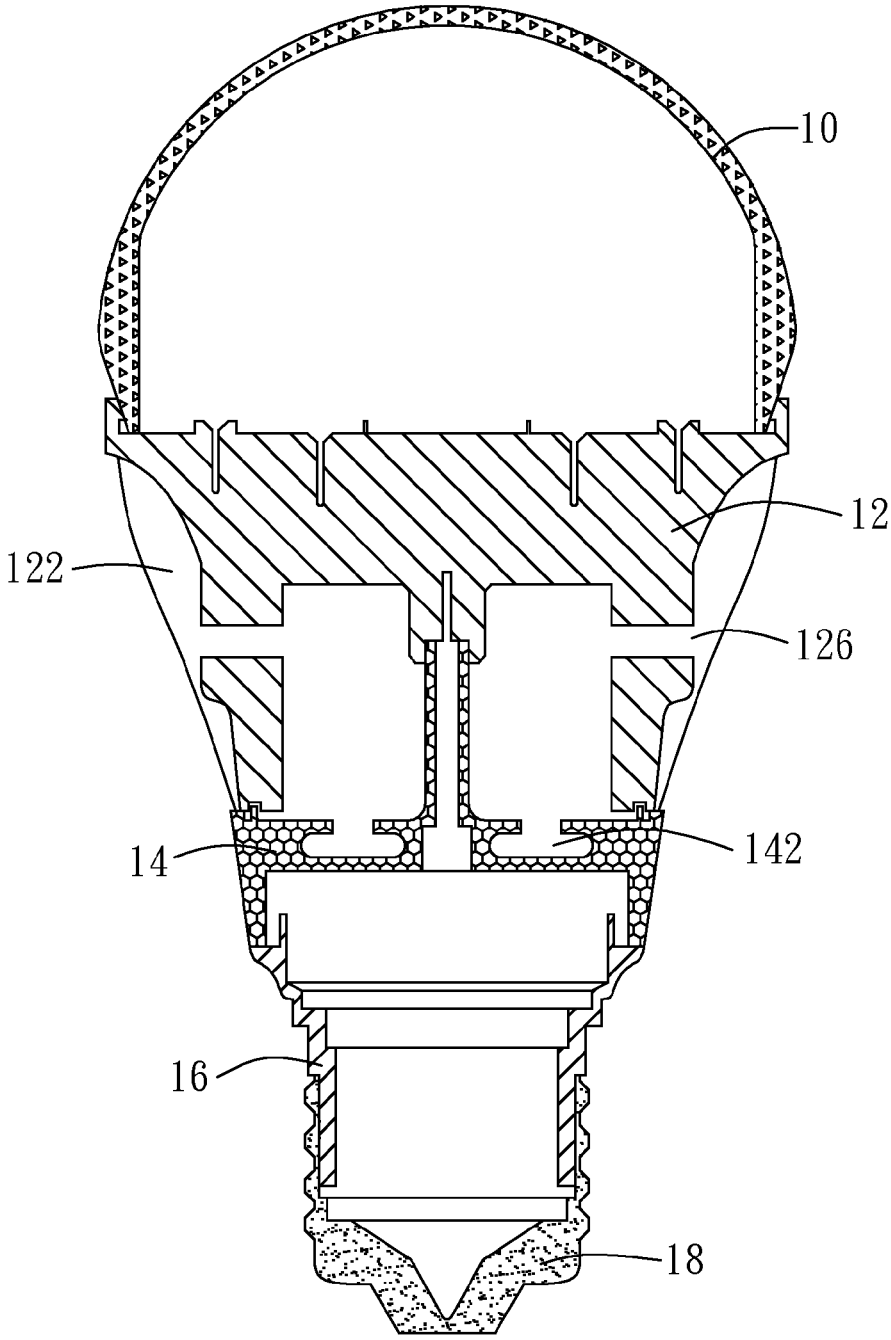
FIG. 1C shows a cross-sectional view of the assembled lighting device of FIG. 1A.

FIG. 1A shows an exploded view of a lighting device according to one embodiment of the present invention, FIG. 1B shows an external view of an assembled lighting device, and FIG. 1C shows a cross-sectional view of the assembled lighting device. Although a light-emitting diode (LED) bulb is demonstrated in the embodiment, other lighting elements such as an organic light-emitting diode (OLED) may be used as well.

In the embodiment, the lighting device includes a lamp cover 10, a bottom housing 12, a middle housing 14, a top housing 16, and a lamp head 18. Specifically, the lamp cover 10 may be used for diffusing light, protection and dust proof. In the specification, the orientation, of the lighting device is defined according to its normal use, that is, the lamp head 18 as the top and the lamp cover 10 as the bottom.

Figure 2A:
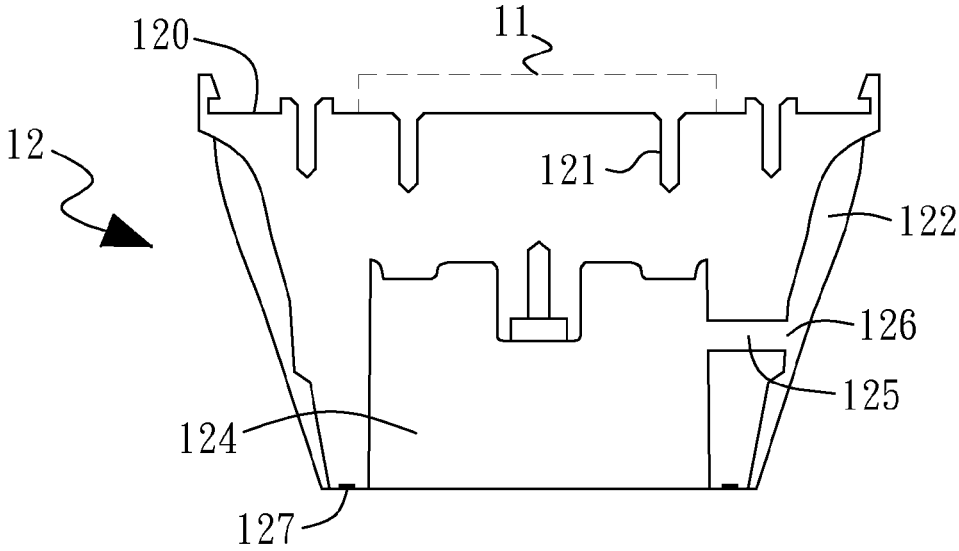
FIG. 2A illustrates a cross-sectional view of the bottom housing along a section line 2A-2A' of FIG. 1A.
Figure 2B:
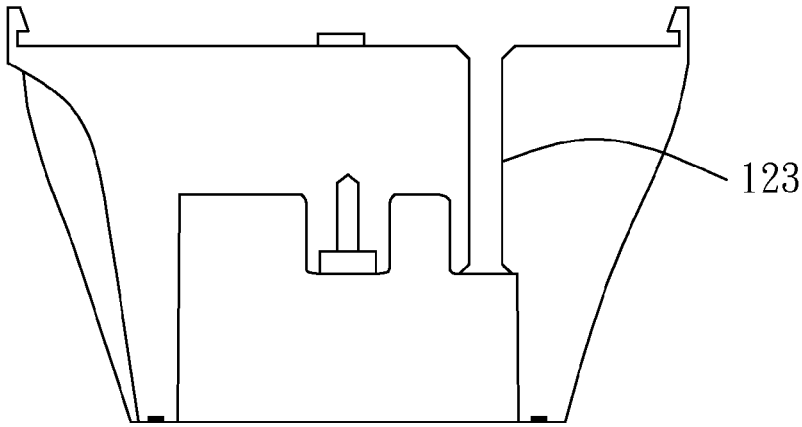
FIG. 2B illustrates a cross-sectional view of the bottom housing along a section line 2B-2B' of FIG. 1A.

FIG. 2A and FIG. 21B show cross-sectional views of the bottom housing 12, where FIG. 2A illustrates the cross-sectional view along a section line 2A-2A' of FIG. 1A, and FIG. 21B illustrates the cross-sectional view along a section line 2B-2B' of FIG. 1A. The lamp cover 10 is coupled to the bottom side of the bottom housing 12. A bottom surface 120 of the bottom housing 12 is capable of supporting a lighting module 11 (e.g., an LED module), which may be fastened to the bottom surface 120 of the bottom housing 12 via at least one threaded hole 121. The sidewall of the bottom housing 12 is equipped with at least one heat dissipation blade 122 for dissipating LED-generated heat out of the lighting device. At least one line hole 123 passes between the top side and the bottom side of the bottom housing 12. The line hole 123 may accommodate connecting wires between the lighting module 11 and a power module (disposed in a space defined by the middle housing 14 and the top housing 16). An air cell 124 is formed in the bottom housing 12 near its top side. The air cell 124 may communicate with outside of the lighting device via an air passage 125 and an air entrance port 126 (disposed on the sidewall of the bottom housing 12). In the embodiment, the bottom housing 12 may be, for example, made of aluminum, copper or ceramic.

In the embodiment, the middle housing 14 is disposed between the bottom housing 12 and the top housing 16, and is primarily used to isolate one from the other such that the LED-generated heat in the bottom housing 12 will not directly affect the power module in the top housing 16. Further, a punctured hole 141 is disposed on a bottom surface 140 of the middle housing 14, and an air exit port 142 is disposed on the sidewall of the middle housing 14. Accordingly, an air channel is thus formed along the air entrance port 126 (of the bottom housing 12), the air passage 125 (of the bottom housing 12), the air cell 124 (of the bottom housing 12), the punctured hole 141 (of the middle housing 14) and the air exit port 142 (of the middle housing 14). Therefore, external air enters the lighting device via the air entrance port 126 and exits from the air exit port 142, thereby carrying the LED-generated heat out of the lighting device. The heat dissipation efficiency may be improved by the air channel in accordance with the heat dissipation blade 122. However, the heat dissipation may be reached using only the air channel.

The middle housing 14 is coupled to the top side of the bottom housing 12. In the embodiment, the middle housing 14 has a hollow fixing pillar 143 extended from the bottom surface 140 of the middle housing 14. The middle housing 14 may be fixed to the bottom housing 12 via the hollow fixing pillar 143 by screwing. The hollow fixing pillar 143 may be replaced with other fixing means such as a hook. Moreover, the middle housing 14 may include a hollow line pillar 144 used, in accordance with the line hole 123, to accommodate connecting wires between the lighting module 11 and a power module. It is appreciated that the connecting wires may pass the middle housing 14 without using the hollow line pillar 144.

The top housing 16 is coupled to the top side of the middle housing 14. In the embodiment, the top housing 16 may be fastened to the middle housing 14 via at least one hook 160. The top housing 16 of the embodiment may be made of plastic or similar material. The lamp head 18 may be made of metal material. The lamp head 18, as an electrode of the lighting device, may cover the sidewall of the top housing 16.

According to one aspect of the embodiment, adhesive dripping 127 may be applied on peripheral area near the top side of the bottom housing 12. The adhesive dripping 127 provides both fastening and water proof between the bottom housing 12 and the middle housing 14.

Although specific embodiments have been illustrated and described, it will be appreciated by those skilled in the art that various modifications may be made without departing from the scope of the present invention, which is intended to be limited solely by the appended claims.

What is claimed is:

1. A lighting device, comprising:

a bottom housing having a bottom surface for supporting a lighting module;

a middle housing coupled to a top side of the bottom housing, wherein the bottom housing and the middle housing are stacked in tandem without overlapping;

a top housing coupled to a top side of the middle housing, wherein the middle housing is disposed between the bottom housing and the top housing; and a lamp head covering a sidewall of the top housing;

wherein an air cell is formed in the bottom housing, the air cell communicating with outside of the lighting device via, an air passage and an air entrance port disposed on a sidewall of the bottom housing; and wherein a punctured hole is disposed on a bottom surface of the middle housing, and an air exit port is disposed on a sidewall of the middle housing, thereby the air exit port and the punctured hole communicating with the air cell of the bottom housing.

2. The lighting device of claim 1, wherein the lighting module comprises at least one light-emitting diode (LED) or organic light-emitting diode (OLED).

3. The lighting device of claim 1, wherein the bottom housing has a threaded hole, by which the lighting module is fastened to the bottom housing.

4. The lighting device of claim 1, wherein the bottom housing comprises at least one heat dissipation blade disposed on a sidewall of the bottom housing.

5. The lighting device of claim 1, wherein the bottom housing has a line hole that passes between a top side and a bottom side of the bottom housing.

6. The lighting device of claim 1, wherein the bottom housing is made of aluminum, copper or ceramic.

7. The lighting device of claim 1, wherein the middle housing comprises a hollow fixing pillar extended from a bottom surface of the middle housing, wherein the middle housing is fixed to the bottom housing via the hollow fixing pillar by screwing.

8. The lighting device of claim 1, wherein the middle housing comprises a hollow line pillar.

9. The lighting device of claim 1, wherein the top housing comprises a hook for fastening the top housing to the middle housing.

10. The lighting device of claim 1, wherein adhesive dripping is applied on peripheral area near the top side of the bottom housing for providing water proof between the bottom housing and the middle housing.

11. The lighting device of claim 1, further comprising a lamp cover coupled to a bottom side of the bottom housing.

* * * * *